United States Patent [19]

Chu et al.

[11] 4,456,240

[45] Jun. 26, 1984

[54] PAPER SUPPLY AND STACKING APPARATUS

[75] Inventors: Mosi Chu, Setauket; David Chiang, Dix Hills; Solomon Manber, Sands Point, all of N.Y.

[73] Assignee: MCC Associates, Short Hills, N.Y.

[21] Appl. No.: 321,419

[22] Filed: Nov. 16, 1981

[51] Int. Cl.[3] ..... B65H 5/22

[52] U.S. Cl. ..... 271/4; 271/145; 271/207; 400/625

[58] Field of Search ..... 271/3.1, 4, 145, 207; 400/625

[56] References Cited

U.S. PATENT DOCUMENTS

| | | | |
|---|---|---|---|
| 4,221,374 | 9/1980 | Koch | 271/4 |
| 4,222,557 | 9/1980 | Wu | 271/9 |
| 4,262,894 | 4/1981 | Marano | 271/4 |

*Primary Examiner*—Richard A. Schacher

*Attorney, Agent, or Firm*—Roberts, Spiecens & Cohen

[57] ABSTRACT

A paper tray has a first bottom, first front and rear walls extending upwardly from the first bottom, first and second side walls extending upwardly from this bottom. The walls and bottom define an open boxlike structure for storage of sheets of paper prior to use. A cover is pivotably mounted to the top of the lower side walls in the region of the rear wall extends toward the first front wall. The cover is shorter than the first bottom to provide a feed gap between the free end of the cover and the front wall so that paper can be removed from the boxlike structure. Each of the lower side walls has an extension upwardly extending beyond the level of the cover. Paper receiving means has a second bottom upwardly displaced from and overhanging the feed gap and the front wall. First and second upper side walls are connected to the ends of the extensions remote from the rear wall and extend upwardly from the upper bottom. A front wall extending upwardly from the edge of the second bottom remote from the connection to the extensions. The second bottom, the upper side walls and front wall define a receptacle for receiving after use sheets of paper initially stored in the defined open boxlike structure.

7 Claims, 2 Drawing Figures

PAPER SUPPLY AND STACKING APPARATUS

BACKGROUND OF THE INVENTION

This invention pertains to the feeding and stacking of paper in a printer.

In word processors and similar types of printers it is often desirable to operate the processor in an automatic mode. In particular one would like to automatically feed a sheet of paper into the processor, initiate the typing and at the end of the typing, feed the completed sheet to a stacking mechanism. At present such facilities are available provided one couples a sheet feeder to the input of the word processor and couples a paper stacker to the output of the printer of the processor. Thus when the processor uses a conventional type roller mechanism the paper is fed from the sheet feeder into say the bottom of the roller and as the paper comes off the top of the roller it is delivered to a conveyor or belt arrangement onto a stacker. Such accessories and, particularly, the stacker portion have been found to be relatively complicated, expensive and unreliable.

Furthermore, there are times when the word processor is to be used in a non-automatic mode. In that case, the operator would normally load the sheet of paper into the bottom of the roller and manually remove the paper from the top of the roller. If the word processor is fitted with the above-mentioned feeder and stacker it is necessary to minimally move the stacker out of position to provide access for the operator to feed and remove the paper. The removal of the stacker quite often causes many complications, so that, in the end, in conventional offices the stacker is permanently removed and the automatic operation only takes place for the feeding part of a cycle.

SUMMARY OF THE INVENTION

It is, therefore, a general object of the invention to provide improved apparatus for feeding paper to and stacking paper from a printer.

According to one aspect of the invention, there is contemplated a paper tray having a first bottom as well as first front and rear walls extending upwardly from the bottom. In addition, first and second lower side walls also extend upwardly from the bottom so that the walls and the bottom define an open boxlike structure for the storage of sheets of paper prior to use. A cover is pivotably mounted on the top of the lower side walls adjacent to the rear wall. This cover extends toward the first front wall but is shorter than the first bottom so that a gap exists between the free end of the cover and the first front wall. Accordingly, paper can be removed from the boxlike structure through such gap. Each of the lower side walls has an extension which upwardly extends beyond the level of the cover. Attached to these extensions is a paper receiving means which has a second bottom upwardly displaced from and overhanging the gap and the first front wall. There are first and second upper side walls connected to the extensions of the lower side walls and extending upwardly from the upper bottom. A second front wall also extends upwardly from the edge of the second bottom remote from its connection to the extensions. The second bottom, the upper side walls and the second front walls define a receptacle for receiving, after use, sheets of paper initially stored in, the defined open box structure.

According to another aspect of the invention, the above-described paper feeding means is not connected to the paper tray but is instead pivotably connected to the portion of the printer which supports the paper tray.

BRIEF DESCRIPTION OF THE DRAWINGS

Other objects, the features and advantages of the invention will become apparent from the following detailed description when read in conjunction with the accompanying drawing which shows the presently preferred embodiment of the invention. In the drawing.

DESCRIPTION OF THE PREFERRED EMBODIMENT

Figure 1:
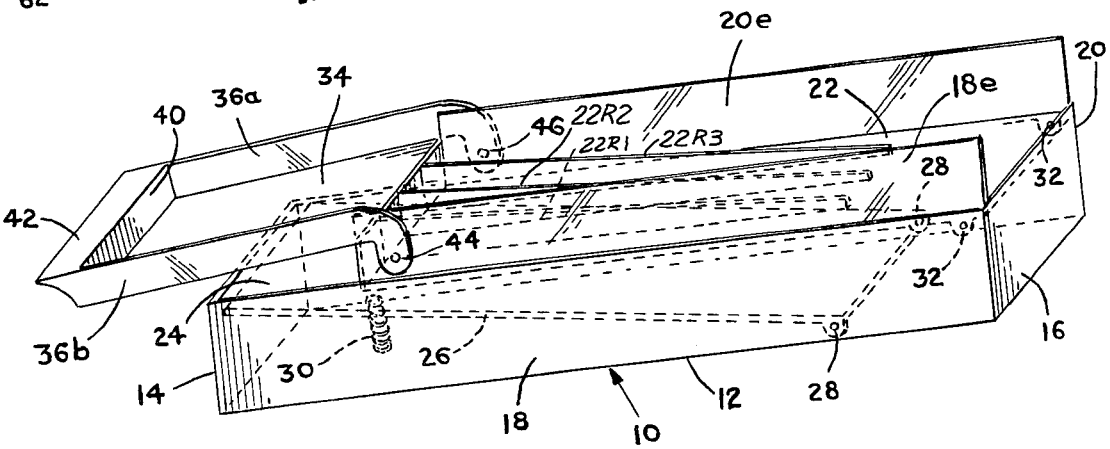
FIG. 1 shows a perspective view of a paper feeding and collecting apparatus in accordance with one pasect of the invention.

In FIG. 1 there is shown the paper tray 10 having two portions: a sheet feeding portion and a sheet receiving and stacking portion.

The sheet feeding portion includes a bottom 12 from which extend upwardly a front wall 14, a rear wall 16, a first side wall 18 and a second side wall 20. The bottom 12 and the walls 14 to 20 define an open boxlike structure in which is stacked a load of paper. Also within the box-like structure is a pivotable floor 26 which pivots about pin 28 mounted in the walls 18 and 20. Between the floor 26 and the bottom 12 is a spring-like member 30 which will urge the paper towards the top of the boxlike structure. The boxlike structure is partially covered by a cover 22 which is pivotally mounted near the top of the side walls 18 and 20 in the region of the rear wall 16. The pivotal mounting is provided by a pin 32 mounted in said side walls.

Connected to this boxlike structure is the stacking portion of the tray. In particular, the side walls 18 and 20 include extensions **18*e* and 20*e* which roughly start at the cover and extend upwardly sufficiently high to stack sheets of paper. Pivotably connected to these extensions and close to the gap 24 is a receiving element having a bottom 34 from which extend upwardly side walls 36*a* and 36*b* and a front wall 40. Extending forward of the front wall 40 is a receiving shelf 42. The entire receiving element is connected to the boxlike structure by means of pins 44 and 46 which provide pivot points between the end of the side walls 36 and 38 respectively and the extensions 18*e* and 20*e* of the side walls 18 and 20. The receiving element can pivot around these pivot points 44 and 46 between the position shown in solid lines and the position shown in dotted lines in FIG. 2. To insure flat stacking of the sheets of paper it is necessary to support the collected sheets substantially parallel to the second bottom 34. This is accomplished by providing ramplike ribs 22R1, 22R2 and 22R3**.

Figure 2:
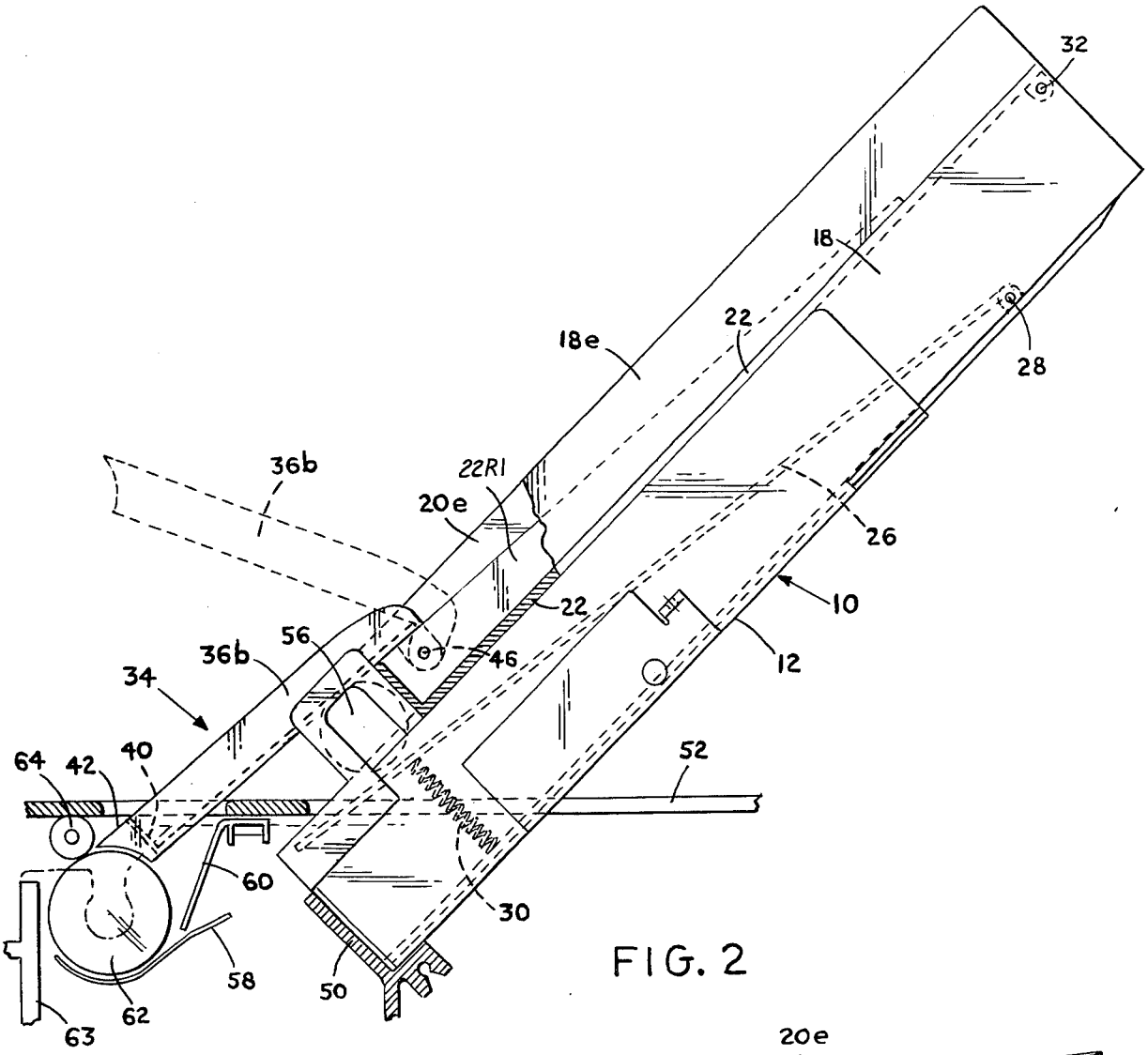
FIG. 2 shows an idealized side view of a portion of a printer in which the apparatus of FIG. 1 is operatively positioned.

In FIG. 2 there is shown the carrier 10 positioned within a printer such as in a word processor. Since the bulk of the printer does not concern the present invention, only those portions of the printer concerned with the invention are shown. In particular, the carrier 10 is supported in the printer by means of the bracket 50. The carrier passes through an opening in the case 52 of the printer. With the carrier in position, the paper within the carrier is urged against the feed roller 56. The feed roller when energized by the printer rotates in a clockwise direction as seen in the Figure and drives the top sheet of paper in the stack onto the paper guide 58. The paper is then urged against the print roller 62. As the paper passes by the print element, it is guided between the print roller 62 and an output roller 64. As the print and output rollers rotate the paper is driven over the receiving shelf 42 into the receiving element. Just before the end of the paper is reached the print roller 62 and the output roller 64 are given a fast rotational pulse to drive the paper into the portion of the carrier defined by the extensions 18*e*, 20*e* and the cover 22.

If the printer is to be used for manual operation one rotates the take-up element to the position shown in dotted lines. At the same time the feed portion of the carrier is emptied of paper and/or the drive roller 56 is disabled. Then an operator merely inserts paper between the print roller 62 and the manual paper guide 60. In this way the paper is guided to the paper guide 58 and the operation proceeds as before, except that this time it is necessary for the operator to manually catch or remove the papers as they are fed from the gap between the print roller 62 and the output roller 64.

There has thus been shown an improved paper carrier which can be used both to feed paper to a printer and to stack the paper fed from the printer. In addition, since the carrier is provided with a rotatable stacking portion and since the printer is provided with two paper guides, the printer can simply be converted between manual and automatic feed operation.

While only one embodiment of the invention has been shown and described in detail, there will now be obvious to those skilled in the art many modifications and variations satisfying many or all of the objects of the invention without departing from the spirit thereof.

What is claimed is:

1. A paper tray comprising a first bottom, first front and rear walls extending upwardly from said first bottom, first and second lower side walls extending upwardly from said bottom, said walls and bottom defining an open boxlike structure for storage of sheets of paper prior to use, a cover pivotably mounted to the top of said lower side walls in the region of said rear wall and extending toward said first front wall, said cover being shorter than said first bottom whereby a gap exists between the free end of said cover and said first front wall so that paper can be removed from the boxlike structure, each of said lower side walls having extensions upwardly extending beyond the level of said cover, and paper receiving means, said receiving means comprising a second bottom upwardly displaced from and overhanging said gap and said first front wall, first and second upper side walls connected to the ends of said extensions remote from said rear wall and extending upwardly from said upper bottom, and a second front wall extending upwardly from the edge of said second bottom remote from the connection to said extensions, said second bottom, said upper side walls and second front wall defining a receptacle for receiving, after use, sheets of paper initially stored in the defined open boxlike structure.

2. The paper tray of claim 1 wherein said connection of said paper receiving means is pivotable.

3. In a printer having a print roller, a print element opposite the print roller and a paper guide for guiding a sheet of paper between the print element and print roller, the improvement comprising: an output roller opposite the print roller and located past the print element; unitary paper feed storage and paper collector means for feeding sheets of paper to a gap between the paper guide and the print roller and for stacking paper delivered by rotation of the print and output rollers, said unitary paper feed storage and paper collector means comprising a first bottom, first front and rear walls extending upwardly from said first bottom, first and second lower side walls extending upwardly from said bottom, said walls and bottom defining an open boxlike structure for storage of sheets of paper prior to use, a cover pivotably mounted to the top of said lower side walls in the region of said rear wall and extending toward said first front wall, said cover being shorter than said first bottom whereby a gap exists between the free end of said cover and said first front wall, so that a paper can be removed from the boxlike structure, each of said lower side walls having extensions upwardly extending beyond the level of said cover, said unitary paper feed storage and paper collector means further comprising paper receiving means comprising a second bottom upwardly displaced from and overhanging said gap and said first front wall, first and second upper side walls connected to the ends of said extensions remote from said rear wall and extending upwardly from said upper bottom, and a second front wall extending upwardly from the edge of said second bottom remote from the connection to said extensions, said second bottom, said upper side walls and second front wall defining a receptacle for receiving, after use, sheets of paper initially stored in the defined open boxlike structure.

4. The improved printer of claim 3 further comprising paper guide means positioned opposite a portion of the print roller for guiding sheets of paper to said gap between the paper guide and print roller whereby sheets of paper can be fed past the print element from two sources.

5. The paper tray of claim 3 wherein said connection of said paper receiving means is pivotable such that controllable access is provided to said paper guide means.

6. In a printer having a print roller, a print element opposite the print roller and a paper guide for guiding a sheet of paper between the print element and print roller, the improvement comprising: an output roller opposite the print roller and located past the print element; unitary paper feed storage and paper collector means for feeding sheets of paper to a gap between the paper guide and the print roller and for stacking paper delivered by rotation of the print and output rollers, paper guide means positioned opposite a portion of the print roller for guiding sheets of paper to said gap between the paper guide and print roller whereby sheets of paper can be fed past the print element from two sources, said unitary paper feed storage and paper collector means including a paper receiver means pivotably supported with respect to the remainder of the unitary paper feed storage and paper collector means for movement between a first position in which sheets of paper can be fed from the unitary paper feed storage as a first of said sources to the print roller and print element via said paper guide and a second position in which sheets of paper can be fed from the second of said sources to the print roller and print element via said paper guide means.

7. The improved printer of claim 6 wherein said unitary paper feed storage and paper collector means comprises an open box-like structure for storage of sheets of paper, a pivotable cover on said box-like structure defining a gap therewith at the front of said box-like structure for removal of sheets of paper therefrom, said paper receiving means being pivotably mounted on said box-like structure above and overhanging said gap, said paper receiving means defining a receptacle for receiving sheets of paper fed to the print roller and print element from said box-like structure.

* * * * *